US006950606B2

(12) United States Patent
Logan et al.

(10) Patent No.: US 6,950,606 B2
(45) Date of Patent: Sep. 27, 2005

(54) AIR CONDITIONING APPARATUS WITH BLOWER AND ELECTRIC HEATER IN COMMON HOUSING

(75) Inventors: Colby W. Logan, Grenada, MS (US); Donald E. Porterfield, Lascassas, TN (US); Jerry L. Hensley, Lebanon, TN (US); James W. Pickle, Grenada, MS (US)

(73) Assignee: Advanced Distributor Products LLC, Grenada, MS (US)

( * ) Notice: Subject to any disclaimer, the term of this patent is extended or adjusted under 35 U.S.C. 154(b) by 24 days.

(21) Appl. No.: 10/751,548

(22) Filed: Jan. 5, 2004

(65) Prior Publication Data

US 2005/0147400 A1 Jul. 7, 2005

(51) Int. Cl.[7] ..... F24H 3/02
(52) U.S. Cl. ..... 392/360; 392/381
(58) Field of Search ..... 392/361–363, 392/364, 370, 372, 381

(56) References Cited

U.S. PATENT DOCUMENTS 3,977,467 A 8/1976 Northrup, Jr.

*Primary Examiner*—Thor S. Campbell
(74) *Attorney, Agent, or Firm*—W. Kirk McCord

(57) ABSTRACT

Air conditioning apparatus is provided in which an air blower and an electric heater assembly are located in a common housing with the heater assembly projecting into the housing from a wall thereof in transverse relationship to the blower. This configuration eliminates the need for a dedicated space for the electric heater downstream of the blower housing, which reduces the size of the apparatus. The wall of the housing includes an opening through which the heater assembly is insertable into the housing. The heater assembly includes a mounting plate to close off the wall opening and to removably mount the heater assembly with the housing. The heater assembly preferably further includes an open coil electric heater, with a major dimension of the heater being oriented generally parallel to the direction of air flow in the blower housing.

18 Claims, 6 Drawing Sheets

AIR CONDITIONING APPARATUS WITH BLOWER AND ELECTRIC HEATER IN COMMON HOUSING

TECHNICAL FIELD

This invention relates generally to air conditioning apparatus and in particular to air conditioning apparatus that includes an electric heater.

BACKGROUND ART

The indoor unit of an air conditioning system, which often is referred to as an air handler, typically includes a cabinet having at least a filter section, a heat exchanger section and a blower section. In electrically powered heating/cooling systems, such as heat pumps, the air handler usually also includes an electric heating section having one or more electric heating elements. The heating section is usually located downstream of the blower section in relation to the direction of air flow in the cabinet. One such air handler is shown and described in U.S. Pat. No. 3,977,467.

In operation, air to be cooled or heated is drawn into the cabinet through a return air duct and is first passed through a filter in the filter section to remove dirt and other debris. After the air passes through the filter, it flows across a heat exchanger coil in the heat exchanger section, which communicates with the suction side of an air blower in the blower section. The blower then discharges the air through the electric heating section into a supply duct that communicates with an indoor space. When the heating/cooling system (e.g., a heat pump system) is operated in a cooling mode and a vapor compression refrigerant is used as the heat transfer fluid, the heat exchanger coil functions as an evaporator to cool the air that flows through the heat exchanger section by vaporization of the refrigerant in the heat exchanger tubes. When the system is operated in a heating mode, the heat exchanger coil functions as a condenser to heat the air by condensation of the refrigerant. The electric heating elements are typically used at the beginning of a heating cycle and may also be used during the heating cycle to supplement the heating provided by the heat exchanger coil.

It is also known in the art to provide an elongated electrically resistive heating element in the blower section. Such heating element is permanently affixed in the blower section and is at least partially wrapped around the blower. Although this configuration eliminates the need for a dedicated electric heating section downstream of the blower section, the heating element is not field-replaceable to accommodate different electrical heating capacities.

SUMMARY OF THE INVENTION

In accordance with the present invention, air conditioning apparatus is provided in which an air blower and an electric heating assembly are located in a common housing and the heating assembly is removably mounted with the housing. This configuration eliminates the need for a dedicated section in the apparatus for the electric heater downstream of the blower section, which reduces the size of the apparatus. Further, the removability feature facilitates replacement of the heater assembly in the field if a different capacity heater assembly is desired or in the event of a component malfunction.

In accordance with one aspect of the invention, the heater assembly is removably mounted with a wall of the housing, such that the heater assembly projects into the housing in transverse relationship to the blower with respect to the general direction of air flow in the housing. In accordance with another aspect of the invention, the heater assembly is comprised of at least one heating element having a major dimension that is generally parallel to the direction of air flow.

In accordance with one embodiment of the invention, the heating element has at least one insulator extending between adjacent portions of the element. The insulator has a major surface and a minor surface, with the major surface being oriented generally parallel to the direction of air flow so as not to restrict air flow.

In accordance with another embodiment of the invention, the blower housing has an open mouth through which air is dischargeable by the blower, a relatively flat portion and a curved portion. The heater assembly projects into the housing from the relatively flat portion. The heater assembly includes a relatively flat mounting plate and is insertable into the blower housing through an opening in the relatively flat portion. The plate is mounted with the housing to close off the opening and defines at least a part of the relatively flat portion.

In accordance with still another embodiment of the invention, the electrical heater is comprised of plural electrically resistive heating elements in an open coil configuration. Each element is comprised of a generally U-shaped coil that follows the general contour of the blower housing adjacent the coil. A major dimension of the coil is parallel to the general direction of air flow in the blower housing.

BEST MODE FOR CARRYING OUT THE INVENTION

The best mode for carrying out the invention will now be described with reference to the accompanying drawings. Like parts are marked in the specification and drawings with the same respective reference numbers. In some instances, proportions may have been exaggerated in order to depict certain features of the invention.

Figure 5:
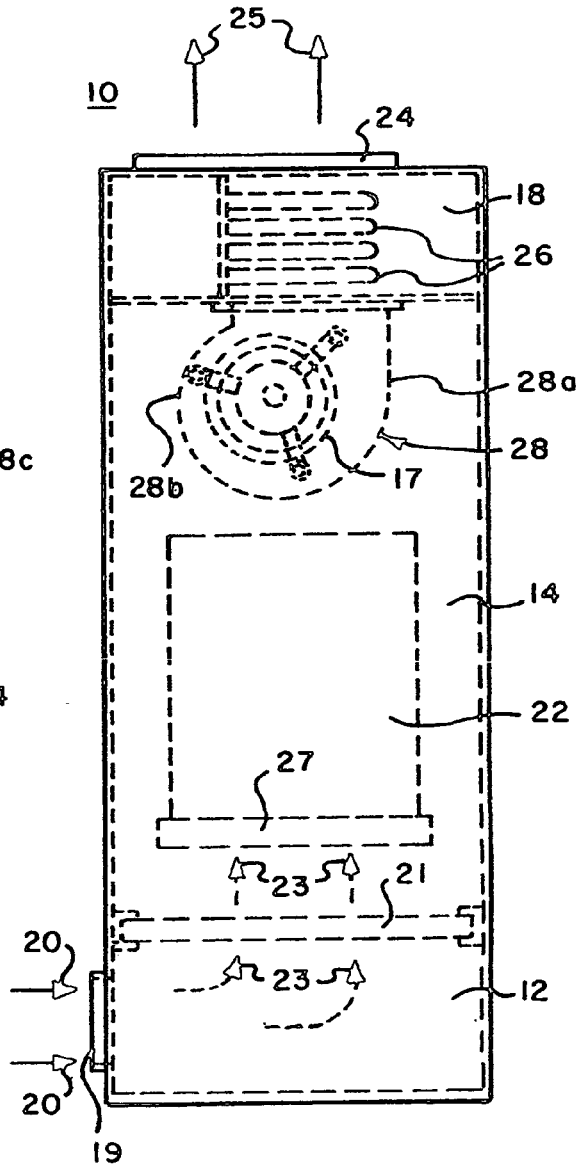
FIG. 5 PRIOR ART
FIG. 5 is a right side elevation view of a prior art air conditioning unit.
Figure 7:
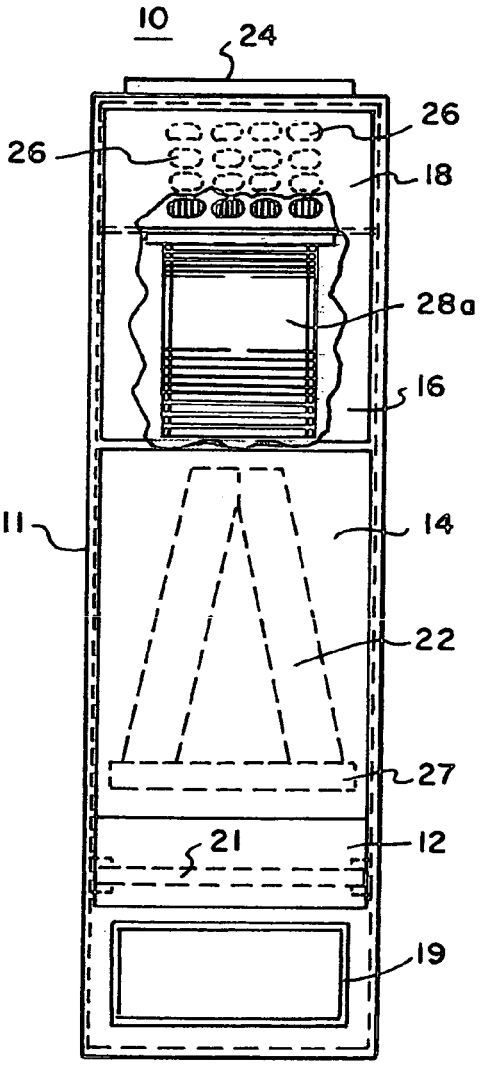
FIG. 7 PRIOR ART
FIG. 7 is a front elevation view of the air conditioning unit of FIG. 5.
Figure 9:
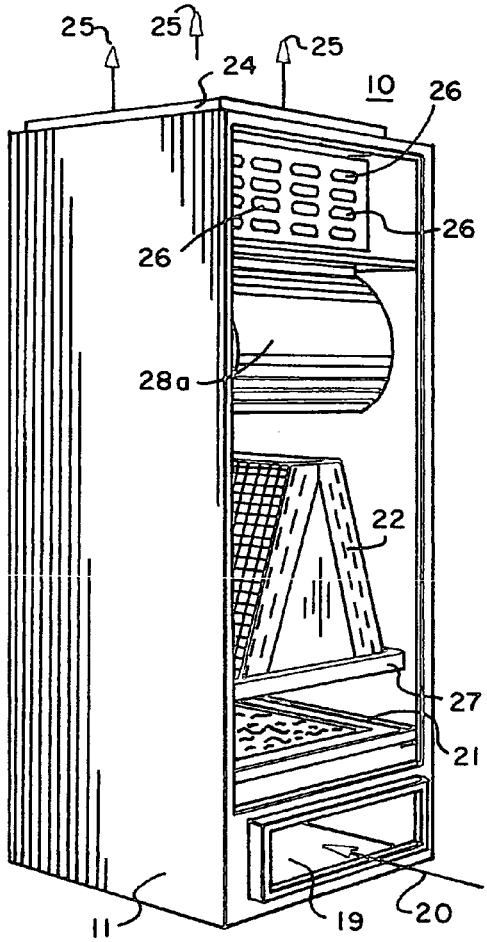
FIG. 9 PRIOR ART
FIG. 9 is a perspective view of the air conditioning unit of FIG. 5.

Referring now to FIGS. 5, 7 and 9, a conventional air handling unit 10 used in an electrically powered heating/ cooling system, such as a heat pump system, is depicted in an upright position for "upflow" operation. Unit 10 includes a cabinet 11, which houses, from bottom to top, a filter section 12, a heat exchanger section 14, a blower section 16 and an electrical heating section 18. In operation, air to be cooled or heated is drawn into cabinet 11 by an air blower 17 in blower section 16 through a return air duct 19 in communication with the lower front portion of cabinet 11, as indicated by directional arrows 20 in FIGS. 5 and 9, and is first passed through a filter 21 in filter section 12 to remove dirt and other debris, as indicated by directional arrows 23 in FIG. 5. After the air passes through filter section 12, it is drawn upwardly by blower 17 through a heat exchanger coil 22 in heat exchanger section 14 into blower section 16 and is then discharged through electrical heating section 18 into a discharge conduit 24, as indicated by directional arrows 25 in FIGS. 5 and 9. Heat exchanger 22 is shown as a conventional tube and fin heat exchanger of the "A-coil" type. A drain pan 27 is located beneath coil 22 to capture condensate runoff therefrom.

When unit 10 is operated in a cooling mode, heat exchanger coil 22 is operative to transfer heat from the air to the heat transfer medium inside the tubes (e.g., by evaporation of the refrigerant when a vapor compression refrigerant is used as the heat transfer medium). Electrical heating section 18 includes plural electrical heating elements 26 in an open coil configuration. Heating elements 26 are inoperative in the cooling mode. When unit 10 is operated in a heating mode, coil 22 transfers heat from the heat transfer medium to the air (e.g., by condensation of the refrigerant when a vapor compression refrigerant is used as the heat transfer medium). Heat exchanger section 14 communicates with the suction side of blower 17. Blower 17 draws air upwardly through heat exchanger 22 and discharges the air into electric heating section 18, wherein the air is heated by electrical heating elements 26 when elements 26 are operative (i.e., typically at the beginning of a heating cycle or whenever supplemental heating is needed). Supply duct 24 communicates between the top portion of cabinet 11 and an indoor space (not shown).

The longitudinal or major axis of each heating element 26 is generally perpendicular to the direction in which air is discharged by blower 17 through heating section 18. Blower 17 is contained in a housing 28 that includes a relatively flat portion 28*a* and a curved portion 28*b*, as can be best seen in FIG. 5. Housing 28 is inserted into cabinet 11 through an opening in the front thereof, which is provided by removing a front panel (not shown) of cabinet 11, such that relatively flat portion 28*a* is inserted first and faces the closed back portion of cabinet 11, with curved portion 28*b* facing toward the front.

Figure 4:
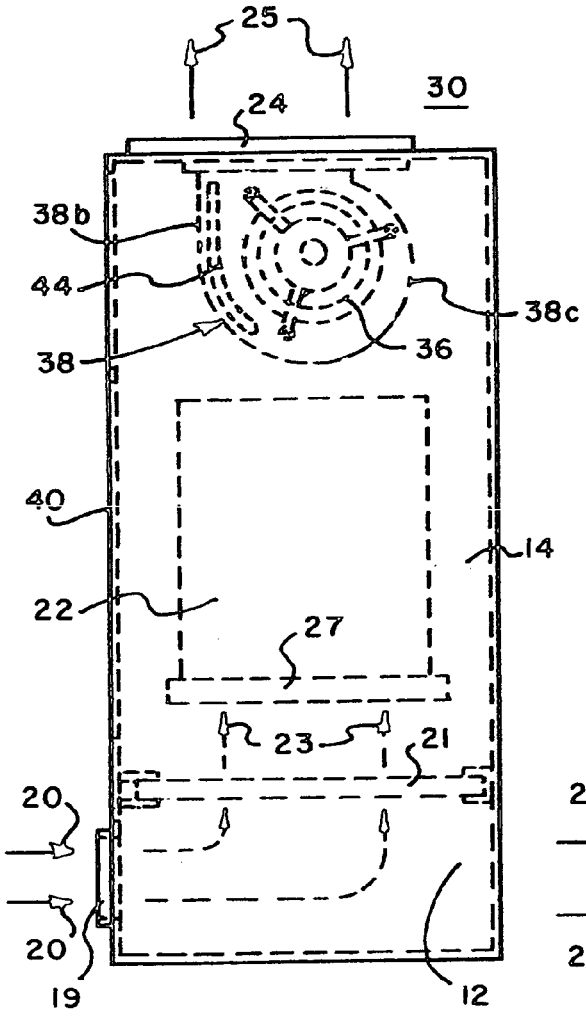
FIG. 4 is a right side elevation view of an air conditioning unit according to the present invention.
Figure 6:
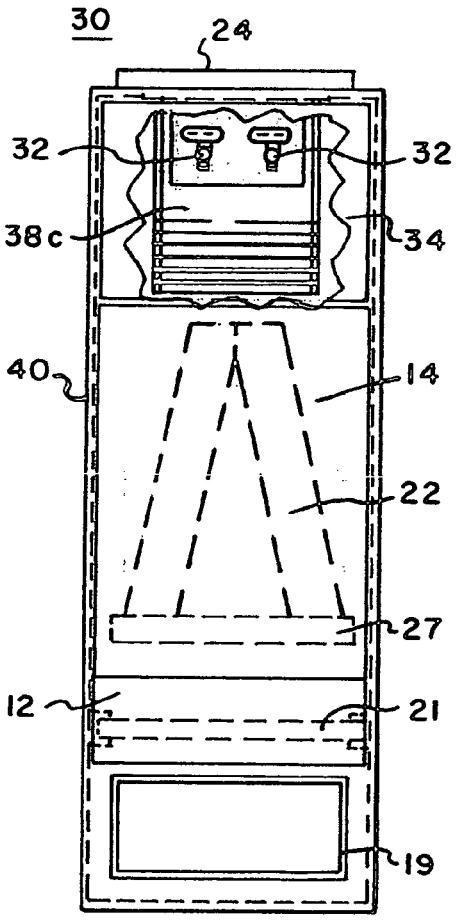
FIG. 6 is a front elevation view of the air conditioning unit of FIG. 4.
Figure 8:
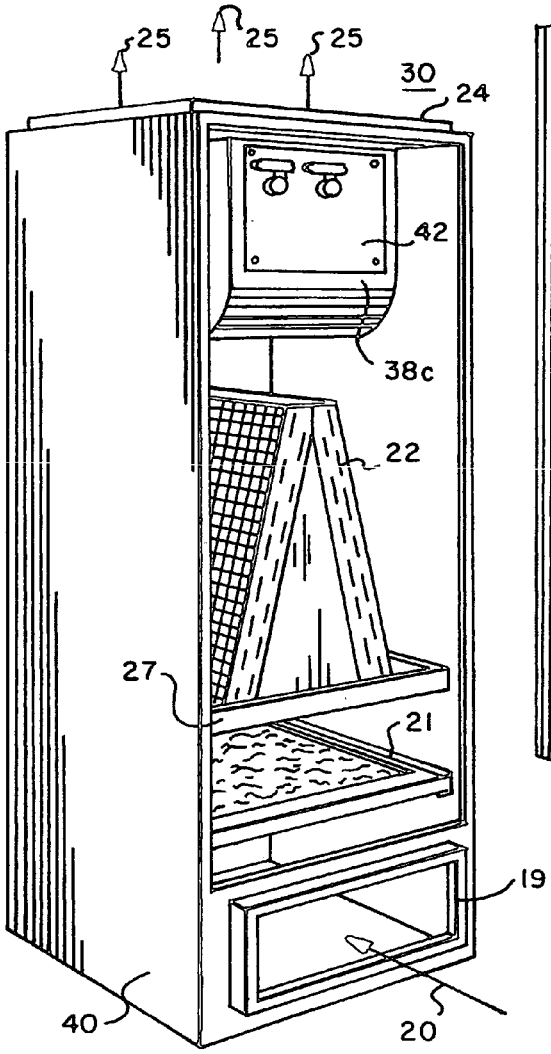
FIG. 8 is a perspective view of the air conditioning unit of FIG. 4.

Referring now to FIGS. 4, 6 and 8, an air handling unit 30 according to the present invention is also depicted in an upright position for "upflow" operation. Unit 30 has essentially the same configuration as prior art unit 10 described hereinabove with reference to FIGS. 5, 7 and 9, except that unit 30 does not have a dedicated electric heating section downstream of its blower section 34. Instead, a heater assembly comprised of plural heating elements 32 and an air blower 36 are both located in a housing 38 in blower section 34. The heater assembly is located in housing 38 in transverse relationship to blower 36 with respect to the general vertical direction of air flow in cabinet 40 of unit 30, as indicated by directional arrows 23 and 25 in FIG. 4.

Figure 1:
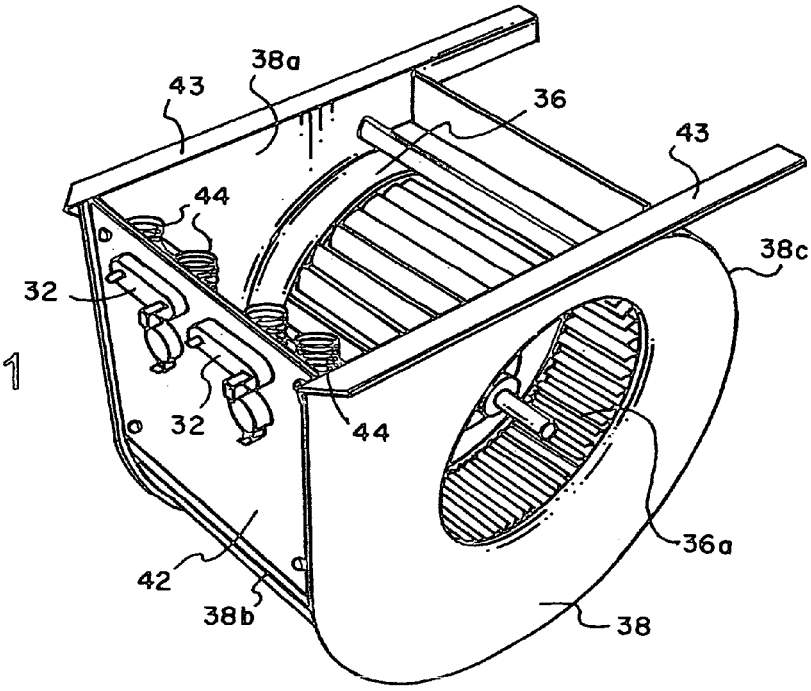
FIG. 1 is a perspective view of a blower housing containing an air blower and electrical heating elements, according to the present invention.
Figure 2:
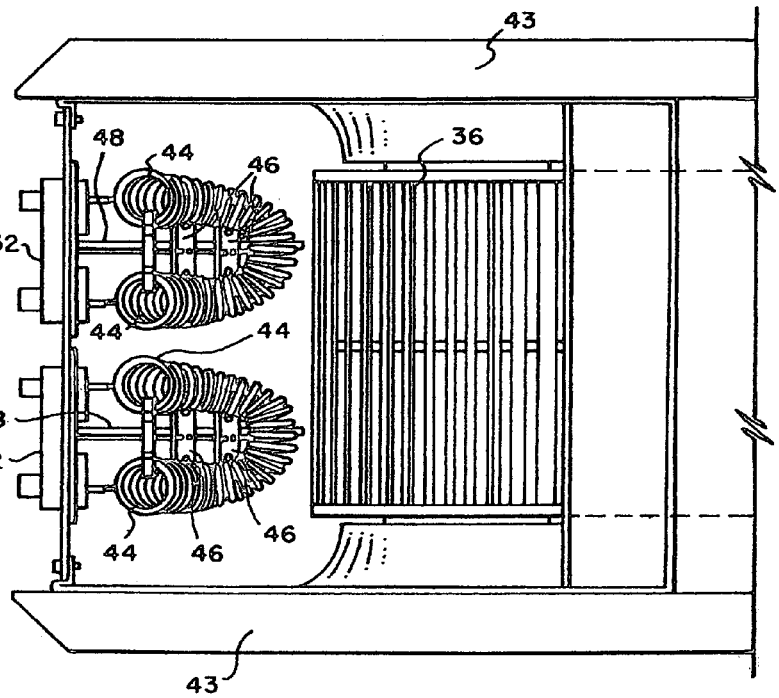
FIG. 2 is a top plan view of the blower housing of FIG. 1.
Figure 3:
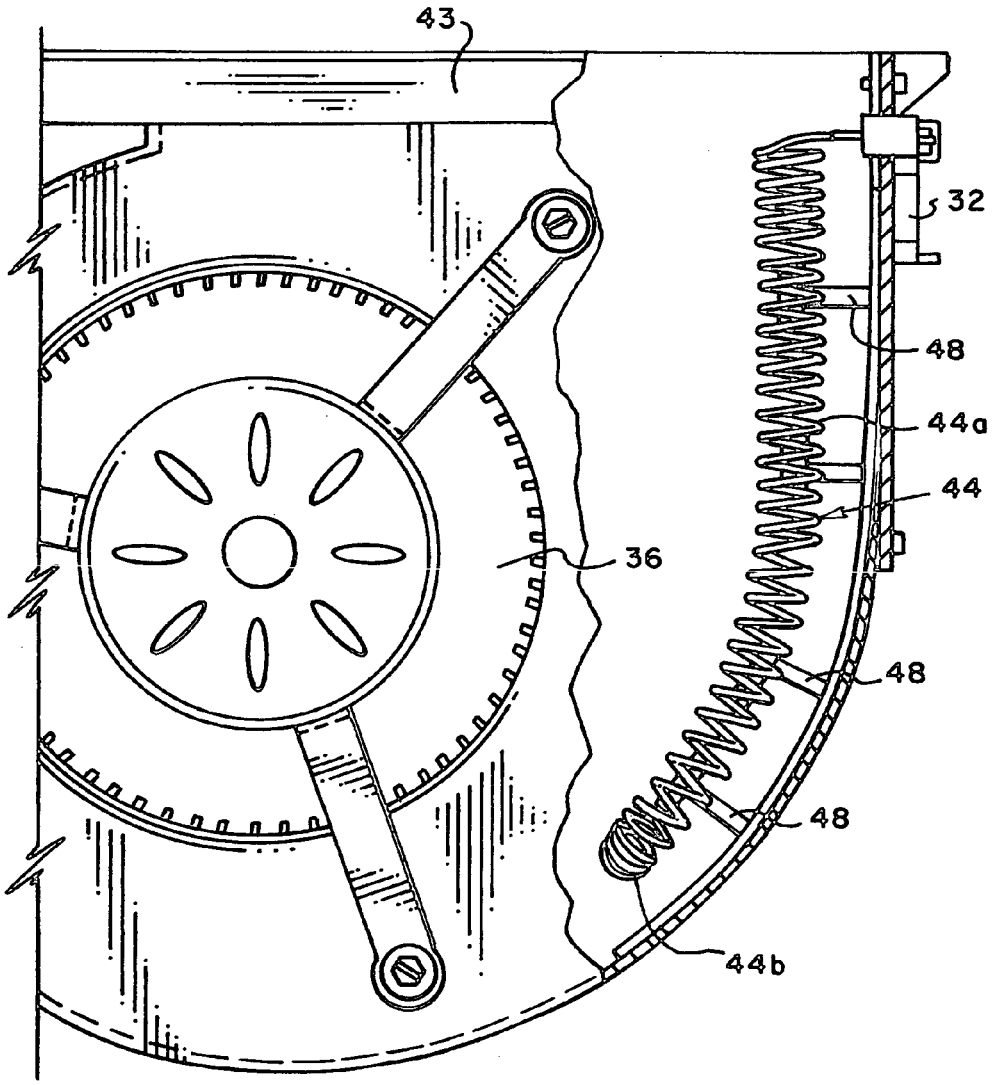
FIG. 3 is a side elevation view of the blower housing of FIG. 1, with a portion of the housing cut away to show an electrical heating element.

Referring also to FIGS. 1–3, blower 36 is preferably a blower of the centrifugal "squirrel cage" type for discharging air radially outwardly by rotation of blower blades 36*a*. Housing 38 has an open mouth 38*a* through which air is dischargeable from housing 38. The wall of housing 38 includes a relatively flat portion 38*b* and a curved portion 38*c*. The heater assembly projects into blower housing 38 from relatively flat portion 38*b*. Heating elements 32 are preferably mounted on a relatively flat plate 42 and are insertable into housing 38 through an opening or cutout (not shown) in relatively flat portion 38*b*. Plate 42 is removably mounted with relatively flat portion 38*b* to close off the opening or cutout in relatively flat portion 38*b*, such that plate 42 defines at least a part of relatively flat portion 38*b*. By removably mounting the heater assembly with blower housing 38, the heater assembly is replaceable in the field if a different capacity heater assembly is desired or in the event of a component malfunction.

To facilitate access to the heater assembly, housing 38 is inserted into cabinet 40 of unit 30 through the open front thereof by inserting curved portion 38*c* first, such that relatively flat portion 38*b* faces the open front of cabinet 40. Flanges 43 on opposed sides of housing 38 facilitate the insertion of housing 38 into cabinet 40 and the mounting of housing 38 with respect to cabinet 40. One skilled in the art will recognize that housing 38 is oriented in the opposite direction from housing 28 in the prior art unit 10 described hereinabove with reference to FIGS. 5, 7 and 9, as can be best seen by comparing FIGS. 4 and 5.

Figure 10:
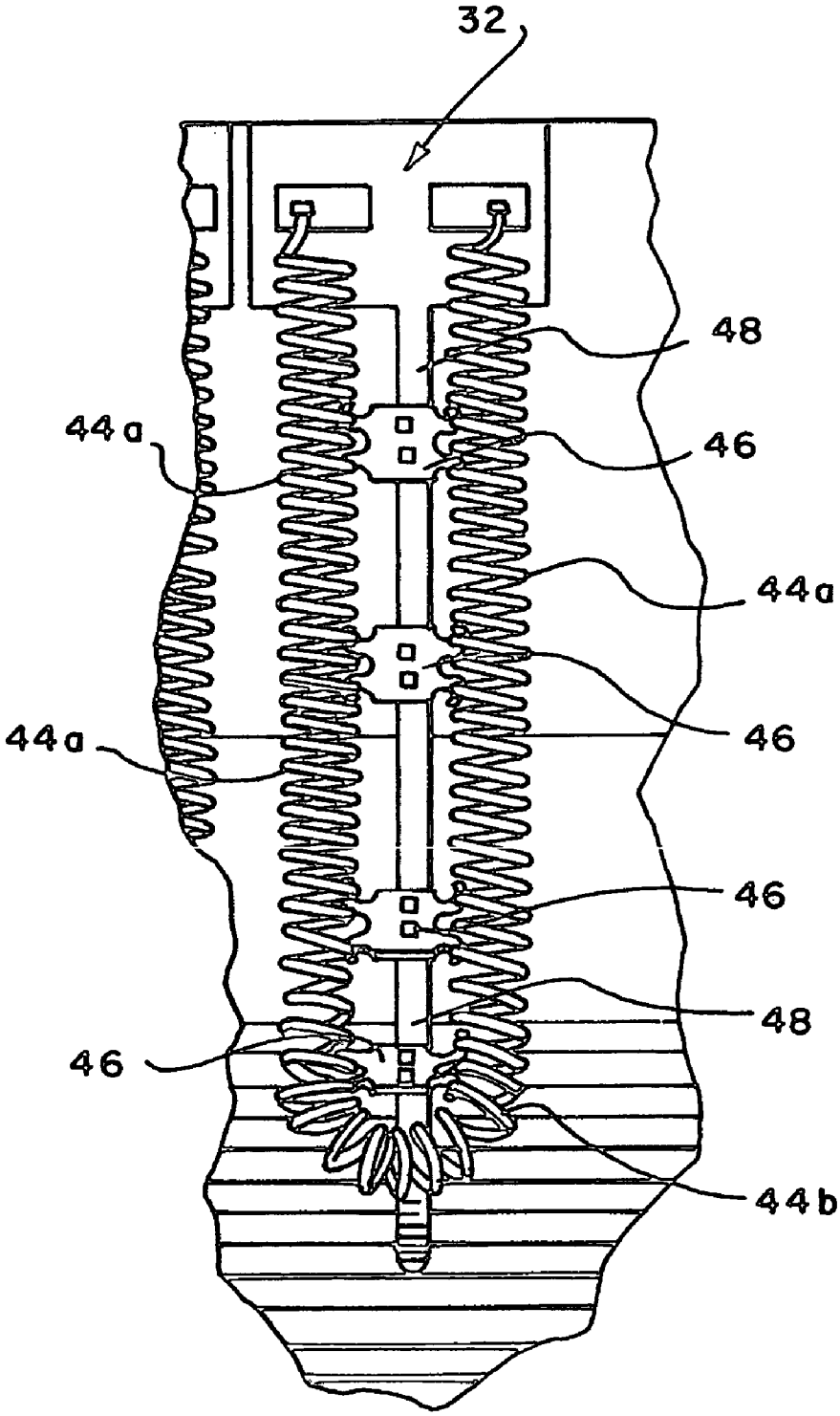
FIG. 10 is a front elevation view of an electrical heating element according to the present invention.

The heater assembly shown in FIGS. 1–4, 6 and 8 is comprised of two distinct heating elements 32, each having an electrically resistive heating coil 44 in an open coil configuration. However, one skilled in the art will recognize that the heater assembly may have more or fewer than two distinct heating elements 32. Referring also to FIG. 10, each heating coil 44 is oriented vertically, such that its major dimension is generally parallel to the direction of air flow in housing 38. Further, each coil 44 is generally U-shaped, as can be best seen in FIG. 10, and is comprised of two parallel legs 44*a* extending along the major dimension of coil 44 with a curved portion 44*b* connecting legs 44*a*. As can be best seen in FIG. 3, each leg 44*a* has a relatively straight upper portion and a slightly inwardly curved lower portion, such that each leg 44*a* follows the contour of the portion of the wall of housing 38 adjacent to coil 44. Specifically, the upper portion of each leg 44*a* is generally parallel to relatively flat portion 38*b* and the lower portion of each leg 44*a* is generally parallel to curved portion 38*b*. Ceramic insulators 46 are interposed between the legs 44*a* of each coil 44 to insulate coils 44 from the metal mounting members 48 used to mount coils 44 in relatively fixed positions within housing 38. Insulators 46 are relatively flat and are oriented with their respective major faces parallel to the major dimensions of the corresponding coil 44.

In operation, blower 36 blows air transversely outwardly toward the bottom of coils 44 and upwardly therethrough, whereby the air is heated. By orienting coils 44 so that their respective major dimensions are generally parallel to the air flow, the air is heated along the entire length of each coil 44 to enhance heating efficiency. Further, by orienting coils 44 and insulators 46 parallel to the air flow, the air flow is not substantially restricted by these components. For example, in an air handler for a 3-ton air conditioning system having 1200 cubic feet per minute air flow capacity, each coil 44 may have a length along its major dimension of about 12 inches, with the relatively straight upper portion of each leg 44*a* comprising about five inches of the overall 12 inch length. Each coil 44 may be comprised of 16 or 18 gage wire in a spiral wound configuration, with a diameter of about 0.675 inch.

By eliminating a dedicated electric heating section from the air handler cabinet in accordance with the present invention, the size of the air handler may be reduced by as much as 10 inches in comparison to prior art air handlers of similar capacities. This size reduction allows an air handler unit according to the present invention to be installed in more restricted spaces than would otherwise be possible and reduces the cost of the air handler.

The best mode for carrying out the invention has now been described in detail. Since changes in and additions to the above-described best mode can be made without departing from the nature, spirit and scope of the invention, the invention is not to be limited to the above-described best mode, but only by the appended claims and their equivalents.

What is claimed is:

1. In air conditioning apparatus having a cabinet containing a blower assembly, said blower assembly having an air blower for moving air through said cabinet in a predetermined direction and a housing in which said blower is located, wherein the improvement comprises an electric heater assembly projecting into said housing from a wall thereof in transverse relationship to said blower with respect to said predetermined direction, said heater assembly being removably mounted with said wall, said heater assembly having a major dimension and a minor dimension, said major dimension being generally parallel to said predetermined direction.

2. The apparatus of claim 1 wherein said heater assembly is comprised of at least one heating coil having a major dimension extending generally parallel to said predetermined direction.

3. The apparatus of claim 2 further including at least one insulator extending between adjacent portions of said at least one coil, said at least one insulator having a major surface and a minor surface, said major surface being generally parallel to said predetermined direction.

4. The apparatus of claim 2 wherein said blower is a centrifugal blower adapted to discharge air transversely toward said heater assembly and along said major dimension of said at least one coil.

5. The apparatus of claim 1 wherein said heater assembly includes at least one generally U-shaped heating coil having parallel legs extending along a major dimension of said coil and a curved portion connecting said legs.

6. The apparatus of claim 1 wherein said housing has an open mouth through which air is dischargeable by said blower in said predetermined direction, said wall having a relatively flat portion and a curved portion, said heater assembly projecting into said housing from said relatively flat portion.

7. The apparatus of claim 6 wherein said heater assembly includes at least one heating element and a relatively flat plate on which said heating element is mounted, said heating element being insertable into said housing through an opening in said relatively flat portion, said plate being removably mounted with said wall to close off said opening and to define at least part of said relatively flat portion.

8. Air conditioning apparatus, comprising:

a cabinet having a blower assembly located therein, said blower assembly including an air blower for moving air through said cabinet in a predetermined direction and a housing in which said blower is located; and an electric heater assembly projecting into said housing from a wall thereof, said heater assembly including at least one heating coil having a major dimension extending generally parallel to said predetermined direction.

9. The apparatus of claim 8 wherein said heater assembly includes plural heating coils in parallel array, each of said coils being generally U-shaped with parallel legs extending along said major dimension and a curved portion connecting said legs.

10. The apparatus of claim 9 further including at least one insulator extending between the legs of each coil, said at least one insulator having a major surface and a minor surface, said major surface being oriented generally parallel to said predetermined direction.

11. The apparatus of claim 8 wherein said coil is positioned in transverse relationship to said blower relative to said predetermined direction.

12. The apparatus of claim 8 wherein said housing has an open mouth through which air is dischargeable by said blower in said predetermined direction, said wall having a relatively flat portion and a curved portion, said heater assembly projecting into said housing from said relatively flat portion.

13. The apparatus of claim 12 wherein said heater assembly includes at least one heating element and a relatively flat plate on which said heating element is mounted, said heating element being insertable into said housing through an opening in said relatively flat portion, said plate being removably mounted with said wall to close off said opening and to define at least part of said relatively flat portion.

14. Air conditioning apparatus, comprising:

a cabinet having a blower assembly located therein, said blower assembly including an air blower for moving air through said cabinet in a predetermined direction and a housing in which said blower is located, said housing having an open mouth through which air is dischargeable by said blower in said predetermined direction; and an electric heater electric heater assembly projecting into said housing from a wall thereof and being removably mounted with said wall, said electric heater being positioned laterally with respect to said blower, said blower being operable to move air laterally toward said electric heater and upwardly therethrough before the air is discharged from said housing though said open mouth.

15. The apparatus of claim 14 wherein said housing has a wall with a curved portion and a relatively flat portion, said electric heater projecting into said housing from said relatively flat portion.

16. The apparatus of claim 15 wherein said electric heater includes at least one heating element and a relatively flat plate on which said heating element is mounted, said heating element being insertable into said housing through an opening in said relatively flat portion, said plate being removably mounted with said wall to close off said opening and to define at least part of said relatively flat portion.

17. The apparatus of claim 15 wherein said electric heater includes at least one heating coil oriented generally parallel to said predetermined direction, said coil having a relatively straight portion that is generally parallel to said relatively flat portion of said wall and a curved portion that is generally parallel to said curved portion of said wall.

18. The apparatus of claim 15 wherein electric heater includes at least one generally U-shaped coil having parallel legs extending along said predetermined direction, each leg having a relatively straight portion that is generally parallel to said relatively flat portion of said wall and a curved portion that is generally parallel to said curved portion of said wall.

* * * * *